US006123885A

United States Patent [19]

Kausch et al.

[11] Patent Number: 6,123,885

[45] Date of Patent: Sep. 26, 2000

[54] PROCESS FOR THE PRODUCTION OF ELASTANE FIBERS BY INCLUSION OF A COMBINATION OF PDMS AND ETHOXYLATED PDMS IN THE SPINNING SOLUTION

[75] Inventors: Michael Kausch; Karl-Heinz Wolf, both of Köln; Wolfgang Klein, Dormagen; Konrad Schmitz, Pulheim, all of Germany

[73] Assignee: Bayer Aktiengesellschaft, Leverkusen, Germany

[21] Appl. No.: 08/300,669

[22] Filed: Sep. 2, 1994

[30] Foreign Application Priority Data

Sep. 10, 1993 [DE] Germany ..... 43 30 725

[51] Int. Cl.[7] ..... B27B 17/00

[52] U.S. Cl. ..... 264/130; 264/211.4; 264/211.19; 264/204; 264/183

[58] Field of Search ..... 428/357, 284, 428/286, 258, 289, 270, 375, 391, 448, 370, 399; 427/171, 177; 264/130, 211.19, 211.4, 183, 204

[56] References Cited

U.S. PATENT DOCUMENTS

| | | | |
|---|---|---|---|
| 3,296,063 | 1/1967 | Chandler et al. | 161/175 |
| 4,105,567 | 8/1978 | Koerner et al. | 252/8.6 |
| 4,217,228 | 8/1980 | Koerner et al. | 252/8.6 |
| 4,296,174 | 10/1981 | Hanzel et al. | 428/389 |
| 4,571,417 | 2/1986 | Thoma et al. | 525/63 |
| 4,578,116 | 3/1986 | Rott et al. | 106/18.12 |
| 4,729,190 | 3/1988 | Lee | 47/57 |
| 4,840,846 | 6/1989 | Ejima et al. | 428/373 |
| 5,045,387 | 9/1991 | Schmalz | 428/284 |
| 5,288,516 | 2/1994 | Anderson | 427/171 |

FOREIGN PATENT DOCUMENTS

| | | |
|---|---|---|
| 0317243 | 5/1989 | European Pat. Off. . |
| 0397121 | 11/1990 | European Pat. Off. . |
| 0393422 | 10/1991 | European Pat. Off. . |
| 0579979 | 1/1994 | European Pat. Off. . |

*Primary Examiner*—Merrick Dixon

*Attorney, Agent, or Firm*—Norris, McLaughlin & Marcus, P.A.

[57] ABSTRACT

The invention relates to a spinning process, more particularly a dry spinning process, for the production of elastane fibers in which 0.8 to 2% by weight of polydimethylsiloxane with a viscosity of 50 to 300 cSt and 0.2 to 0.6% by weight of ethoxylated polydimethylsiloxane with a viscosity of 20 to 150 cSt are added to the elastane spinning solution before it is spun.

9 Claims, No Drawings

PROCESS FOR THE PRODUCTION OF ELASTANE FIBERS BY INCLUSION OF A COMBINATION OF PDMS AND ETHOXYLATED PDMS IN THE SPINNING SOLUTION

This invention relates to a spinning process, more particularly a dry spinning process, for the production of elastane fibers in which 0.8 to 2% by weight of polydimethylsiloxane with a viscosity of 50 to 300 cSt and 0.2 to 0.6% by weight of ethoxylated polydimethylsiloxane with a viscosity of 20 to 150 cSt are added to the elastane spinning solution before it is spun.

Elastane fibers are fibers of which at least 85% by weight consist of segmented polyurethanes. The elastic and mechanical properties of elastane fibers are established by the use of polyurea polyurethanes based on aromatic diisocyanates, for example, for the production of the elastane fibers. Elastanes of the type in question are typically produced by wet spinning or preferably dry spinning the solutions. Suitable solvents for both processes are polar solvents, for example dimethyl sulfoxide, N-methyl pyrrolidone, dimethyl formamide and preferably dimethyl acetamide.

Commercial yarns produced from such fibers have been known for many years. The most important application for fibers of the type in question is the elasticizing function for linen, corsetry and swimwear articles and their use in garter welts for socks and stockings and also elastic bands. By far the largest quantity of elastane filament yarns is processed in warp and raschel knitting machines for the major fields of fashion swimwear and girdles. To this end, up to 1,500 filaments are wound adjacent one another onto a warp beam under constant, controlled elongation, for example in an expander-type warping frame. A warp consisting of several warp beams is then processed together with one or more warps of non-elastic base yarns (for example polyamide) to form a full-width fabric. Elastane-containing materials with elastane fiber contents of up to at most around 20% are produced from these fabrics by dyeing and finishing, receiving not only their color and appearance, but also their final textile and mechanical (elastic) properties through these subsequent treatment steps.

At this stage of the production process, it has been found that, where they have been dyed in a single color, the textiles often show visible streaks so that they can only be used to a limited extent, if at all. This streakiness is assumed to be caused by irregularities in the thickness and elasticity of the elastane filaments used, although the exact cause is very difficult to pinpoint because the unwanted streakiness can only be detected after a plurality of process steps has been carried out.

The problem addressed by the present invention was to provide improved elastane fibers which, after processing on warp knitting machines, would produce distinctly less streakiness in dyed and finished textiles without any adverse effect on their processability in the intermediate steps required for the production of the textiles.

It has now surprisingly been found that this problem can be solved by adding a mixture of polydimethylsiloxane (PDMS) with a viscosity of 50 to 300 cSt and ethoxylated polydimethylsiloxane to the polyurethane urea solution before it is spun and then carrying out the spinning process.

The present invention relates to a process for the production of elastane fibers from polyurea polyurethanes by dry spinning or wet spinning comprising the steps of spinning, removal of the spinning solvent, finishing, optionally twisting and winding of the spun fibers, characterized in that A) from 0.8 to 2% by weight of polydimethylsiloxane with a viscosity of 50 to 300 cSt and B) from 0.2 to 0.6% by weight of ethoxylated polydimethylsiloxane with a viscosity of 20 to 150 cSt (viscosities measured with a falling ball viscosimeter at 25° C.) are added to the spinning solution before it is spun, the percentages shown being based on the siloxane content of the final fiber. The viscosity of the PDMS used must not under any circumstances fall below 50 cSt because otherwise the desired effect would no longer occur. The ethylene-oxide-modified polydimethylsiloxanes suitable for use in accordance with the invention preferably correspond to general formula I:

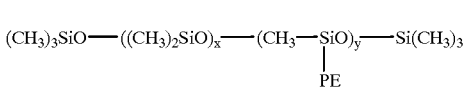

$$(CH_3)_3SiO-((CH_3)_2SiO)_x-(CH_3-\underset{\underset{PE}{|}}{SiO})_y-Si(CH_3)_3 \quad (I)$$

in which PE is the single-bond unit $CH_2CH_2—CH_2O(Eo)_mZ$. In this formula, Eo stands for ethylene oxide and Z is either hydrogen or a $C_{1-6}$ alkyl radical and x, y and m are integers of or greater than 1 which are preferably selected so that formula (I) does not exceed a molecular weight of 4,000.

Products of this type are produced, for example, by Union Carbide under the trade name of Silwet®. Types with a viscosity of 20 to 150 cSt and a molecular weight of around 600 to 4,000 are suitable for use in accordance with the invention. Unless otherwise specifically stated, all molecular weights are number average molecular weights ($M_n$).

The inclusion of pure polydimethylsiloxane (PDMS) in the spinning solution is known in principle and is described, for example, in DE-A-3 912 510, according to which elastanes are produced by a special spinning process, namely a dry spinning process for the production of coarse-denier elastane fibers with introduction of superheated steam. This document refers to silicone oils as flow promoters among other possible additives. U.S. Pat. No. 4,973,647 also mentions the inclusion of silicone oil in the spinning solution. Neither document makes any reference to the effects of the oil after further processing nor do they mention the inclusion of a special combination of oils with certain properties in the spinning solution.

The inclusion of amylsiloxane-modified polydimethylsiloxane oils in the spinning solution, which is not the subject of the present invention, is known from DE-AS 1 469 452.

It is not apparent from any of these documents whether the inclusion of pure or modified PDMS in the spinning solution is capable of influencing or improving the properties of the fibers, more particularly the optical uniformity of elastic warp-knitted fabrics of these elastane fibers.

The application of mixtures of polydimethylsiloxane and polyether-modified PDMS to the spun elastane filaments by dipping or spraying or by roller is also known (see JP 57 128 276 or JP 03 146 774).

The object of applying finishing oils such as these is to improve the take-off properties of the elastane fibers in warping and knitting processes. The inclusion of the mixtures in the spinning solution is not mentioned in these documents, nor do they contain any reference to the fact that mixtures, especially those having the composition according to the invention, included in the elastane spinning solution produce an improvement in the optical properties of warp-knitted fabrics obtained therefrom.

The polyurea polyurethanes are produced by methods known per se. A method which has proved to be particularly successful for the synthesis of these fiber raw materials is the prepolymer process in which, in a first step, a long-chain diol is reacted with a diisocyanate in a solvent or in the melt to form a prepolymer in such a way that the reaction product is terminated by isocyanate groups.

Preferred diols are, on the one hand, polyester diols and, on the other hand, polyether diols. Mixtures of polyester and polyether diols may also be used. The diols generally have a molecular weight of 1,000 to 6,000.

Suitable polyester diols are, for example, dicarboxylic acid polyesters which may contain both several different alcohols and also several different carboxylic acids. Mixed polyesters of adipic acid, hexanediol and neopentyl glycol in a molar ratio of 1:0.7:0.43 are particularly suitable. Suitable polyesters preferably have a molecular weight of 1,000 to 4,000.

Suitable polyether diols are, for example, polytetramethylene oxide diols, preferably having molecular weights of 1,000 to 2,000.

Polyester and/or polyether diols may also be used in combination with diols containing tertiary amino groups. N-alkyl-N,N-bis-hydroxyalkylamines for example are particularly suitable. Suitable components are, for example, 4-tert.butyl-4-azaheptane-2,6-diol, 4-methyl-4-azaheptane-2,6-diol, 3-ethyl-3-azapentane-1,5-diol, 2-ethyl-2-dimethylaminomethylpropane-1,3-diol, 4-tert.pentyl-4-azaheptane-2,6-diol, 3-cyclohexyl-3-azapentane-1,5-diol, 3-methyl-3-azapentane-1,5-diol, 3-tert.butylmethyl-3-azapentane-1,5-diol and 3-tert.pentyl-3-azapentane-1,5-diol.

In the synthesis of the elastane raw materials, the usual aromatic diisocyanates are optionally used in admixture with small quantities of aliphatic diisocyanates. Particularly useful results are obtained with the following diisocyanates: 2,4-tolylene diisocyanate and corresponding isomer mixtures; 4,4'-diphenylmethane diisocyanate and corresponding isomer mixtures. Mixtures of aromatic diisocyanates may of course also be used.

In another embodiment of the synthesis of elastane raw materials according to the invention, polyester polyurethane and polyether polyurethane prepolymers are mixed and then reacted in known manner to form polyurea polyurethanes. The most favorable polyester diol/polyether diol mixing ratio for this purpose may readily be determined by preliminary tests.

In the synthesis of the polyurea polyurethanes, the required urea groups are introduced into the macromolecules by a chain-extending reaction. The macro diisocyanates synthesized in the prepolymer stage are normally reacted in solution with diamines. Suitable diamines are, for example, ethylenediamine, tetramethylenediamine, 1,3-cyclohexandiamine, isophoronediamine and mixtures of these diamines. The required molecular weight can be adjusted by using a small quantity of monoamines, for example diethylamine or dibutylamine, during the chain-extending reaction. The chain-extending reaction itself may be carried out using $CO_2$ as a retarding agent.

Polyester polyurethane and polyether polyurethane ureas may also be mixed on completion of the elastane synthesis.

The described reactions are normally carried out in an inert polar solvent, such as dimethyl acetamide, dimethyl formamide or the like.

In the process according to the invention, the silicone oils are introduced in concentrations of 0.8 to 2% by weight (for the polydimethylsiloxane) or 0.2 to 0.6% by weight (for the ethoxylated polydimethylsiloxane). The ratio by weight of PDMS to ethoxylated PDMS in the final phase is preferably 1:1 to 5:1. The concentration figures represent the content of oil in the spun elastane filament. The oils are introduced from a stock formulation in which the oils are dispersed in the solvent, for example dimethyl acetamide, together with other spinning aids, such as an antiblocking agent for example. The stock formulation is then added to and mixed with the spinning solution in a static mixer or other mixer. The concentration of the two silicone oils together in the stock formulation is preferably from 15 to 22% by weight.

The elastane filaments are then produced from the spinning solution obtained by wet spinning or dry spinning, preferably by dry spinning. Fibers produced by the process according to the invention preferably have an individual denier of 10 to 160 dtex. Multifilament yarns consisting of 3 to 5 coalesced individual capillaries are particularly preferred. They preferably have a denier of around 33 to 55 dtex.

After leaving the spinning tube, the fibers may be provided with a typical external finish to facilitate their processing in the subsequent warping and knitting processes.

The present invention also relates to the elastane fibers obtainable by the process according to the invention.

The test described in the following was used to show that the elastane filaments produced in accordance with the invention provide the fabrics knitted from them with distinctly better uniformity than elastane filaments produced by a standard process.

DESCRIPTION OF THE TEST

In a first step, 1,340 filaments with a denier of dtex of 45 are warped with a preliminary draft of 156% and a final draft of 40% onto two sectional warp beans (SWBs) of an elastane warping machine (type DSE 50/30, Karl Mayer, Oberhausen).

In a second step, an elastic warp-knitted fabric is produced from these sectional warp beams together with two SWBs of polyamide dtex 44/10 (a product of SNIA). A type HKS 2/E 32 warp loom (Karl Mayer, Oberhausen) is used as the warp knitting machine. The filament feed values are 59.0 cm for the elastane and 160.0 cm for the polyamide.

The warp-knitted fabric thus produced is then relaxed on a steaming table with a vibration attachment, any differences in stitch density and fabric width largely being removed from the raw fabric.

The non-prewashed fabric is then fixed with hot air on a tenter frame for 40 seconds at 195° C. with an overfeed of 8%. The fixing width is 100 cm.

In a separate pass through the tenter frame, the fixed fabric is wound cold onto perforated dyeing beams.

The fabric is dyed either white or blue in a beam dyeing system using the following standard formulations:

A) For the color white:

| | |
|---|---|
| 2.0 g/l | Blankit IN (a product of BASF AG; techn. sodium dithionite) |
| 2.0% | Blankophor CLE fl. (a product of Bayer AG; optical brightener for polyamide, elastane) |
| 0.3 ml/l | Acetic acid |

Before all the auxiliaries are added, the closed system is first filled with water with no circulation of liquor (for thorough venting). The auxiliaries mentioned above are added after the circulation pump has been switched on and the required pressure of 2.2/2.0 bar has been established. The liquor is heated at 1° C. per minute, the liquor being pumped from outside inwards up to 80° C. and then from inside outwards beyond 80° C. After the required final temperature of 90° C. has been reached, the further treatment time is 45 minutes. The fabric is then indirectly cooled to 70° C., continuously rinsed to room temperature by introduction of fresh cold water and, finally, is rinsed once more with fresh water.

B) For the color blue:

The procedure in the beam dyeing system largely corresponds to that for the color white except for the following changes to the composition of the dye:

| | |
|---|---|
| 0.90% | Telon Lichtblau RR 182% (a product of Bayer AG; acid dye) |
| 0.05% | Telon Echtorange AGT 200% (a product of Bayer AG, acid dye) |
| 2.00 g/l | Sodium acetate |
| 1.50% | Levegal FTS (a product of Bayer AG; levelling agent, mixture of sulfonate and polyglycol ether derivative) |
| 0.30 ml/l | Acetic acid |

Dyeing time 60 mins. at 98° C.

After dyeing, the dyeing beams are delivered with the wet fabric to the padding machine where they are rinsed with water and uniformly squeezed dry.

Subsequent intermediate drying takes place at 120° C. in a screen drum dryer over which the fabric travels at a rate of approximately 7 m/minute. The fabric is folded flat on entering the screen drum dryer.

Finally, the intermediately dried fabric is tentered in a tenter frame at a temperature of 150° C. and at a speed of 10 m/minute for an overfeed of 5%, resulting the formation of a smooth fabric with the prescribed width which is wound into roll form on leaving the tenter frame.

Optical uniformity is evaluated on a scale of 1 to 9 (test scores) by visual inspection of the dyed fabric both in transmitted light and in reflected light. This scale is applicable to all elastane deniers. Scores of 1 to 3 can only be achieved with relatively coarse deniers (>dtex 80). For the denier of dtex 45 described herein, a score of 4 signifies an extremely uniform fabric, a score of 5 only corresponds to good uniformity while a score of 6 corresponds to a satisfactory uniformity which still corresponds to 1a fabric.

If fabric is given a score of 7, it can only be used for special purposes while fabrics with scores of 8 to 9 are unsaleable.

EXAMPLES

The following Examples demonstrate the more favorable optical uniformity of dyed knitted fabrics produced with elastanes according to the invention.

The superiority of the elastane fibers according to the invention (see Examples 1, 3, 5 and 7 according to the invention) becomes clear by comparison with fibers which only differ in their composition in regard to inclusion of the mixtures of polydimethylsiloxane and ethoxylated polydimethylsiloxane in the spinning solution (Examples 2, 4, 6, 8 and 9).

In all the Examples, the fabrics were knitted from an elastane polymer which had been produced from a polyester diol, molecular weight 2,000, consisting of adipic acid, hexanediol and neopentyl glycol, capped with methylene-bis-(4-phenyl diisocyanate) ("MDI") and then chain-extended with a mixture of ethylenediamine (EDA) and diethylamine (DEA).

The elastane polymer for each of the Examples was produced by substantially the same method.

In every case, 49.88 parts by weight of polyester diol, molecular weight 2,000, were mixed at 25° C. with 1.00 part by weight of 4-methyl-4-azaheptane-2,6-diol and 36.06 parts by weight of dimethyl acetamide (DMAC) and 13.06 parts by weight of MDI, heated to 50° C. and kept at that temperature for 110 minutes to obtain an isocyanate-capped polymer with an NCO content of 2.65%.

In Examples 1 and 2, after the cooling step, 100 parts of the capped polymer were cooled to 25° C. and rapidly mixed with a solution of 1.32 parts by weight of EDA and 0.03 part by weight of DEA in 189.05 parts of DMAC, so that a spinning solution of the polyurethane urea in DMAC with a solids content of 22.5% was formed.

By addition of hexamethylene diisocyanate (HDI), the molecular weight of the polymer was adjusted in such a way that a viscosity of 70 Pa.s/25° C. and an intrinsic viscosity $\eta_{inh.}$ of 1.4 dl/g were obtained.

For the remaining Examples, chain extension was carried out as follows:

100 Parts of the capped polymer were cooled to 20° C., after which the solution was diluted with 59.85 parts by weight of DMAC. The solution was then intensively mixed with a mixture of 1.23 parts by weight of EDA, 0.08 part by weight of DEA and 60.72 parts by weight of DMAC in a continuous reactor, so that a spinning solution of polyurethane urea in DMAC with a solids content of approximately 30%, a viscosity of 50 Pa.s/50° C. and an intrinsic viscosity $\eta_{inh.}$ of 1.4 dl/g was formed.

After the production of the polymers as described in the foregoing, a stock formulation of additives was introduced. This stock formulation consisted of 58.72 parts by weight of DMAC, 10.32 parts by weight of Cyanox® 1790 (a product of American Cyanamid; stabilizer), 5.16 parts by weight of Tinuvin® 622 (a product of Ciba Geigy; stabilizer), 25.80 parts by weight of a 30% spinning solution and 0.009 part by weight of the dye Makrolex-violett® B (a product of Bayer AG). This stock formulation was added to the spinning solution in such a way that the final filaments contained 1% by weight of Cyanox® 1790 and 0.5% by weight of Tinuvin® 622, based on the solids content of the fiber polymer.

A second stock formulation consisting of 30.94 parts by weight of titanium dioxide (RKB 2, a product of Bayer AG), 44.52 parts by weight of dimethyl acetamide and 24.53 parts by weight of a 22% spinning solution was then added to the spinning solution in such a quantity that the final filaments contained 0.05% by weight of titanium dioxide, based on the polyurethane urea polymer.

Further stock formulations were then added to the spinning solution. They consisted of 4.4 parts by weight of magnesium stearate, 32.3 parts by weight of DMAC, 41.2 parts by weight of 30% spinning solution and quantities of polydimethylsiloxane and ethoxylated polydimethylsiloxane which had been selected so that the percentage contents shown in Examples 1 to 9 were obtained in the final fibers.

Example 1

Additive Content in the Final Fiber

| | |
|---|---|
| 0.3% by weight | magnesium stearate |
| 0.3% by weight | Silwet ® L 7607 (a product of Union |

-continued

| | |
|---|---|
| | Carbide; ethoxylated PDMS) |
| 1.0% by weight | Baysilonöl ® M 100 (a product of Bayer AG) with a viscosity of 100 cSt |

Example 2 (Comparison)
Additive Content in the Final Fiber

| | |
|---|---|
| 0.3% by weight | magnesium stearate without polydimethylsiloxane |
| 0.3% by weight | Silwet ® L 7607 |

In Examples 1 and 2, the spinning solution was dry spun through spinnerets in a typical spinning machine 5 meters in length to form filaments with a denier of 11 dtex, four individual filaments being combined to form coalesced filament yarns with a denier of 44 dtex which were wound at 330 m/minute.

As can be seen from Table 1, a distinct improvement in optical uniformity, as reflected in a score improvement of 0.76 points, is obtained by the inclusion in the spinning solution of a mixture of polydimethylsiloxane and ethoxylated polydimethylsiloxane in accordance with the present invention.

TABLE 1

Improvement of optical uniformity in accordance to the invention

| Example | Number of tests | Test score (average) | Remarks |
|---|---|---|---|
| 1 | 12 | 5.04 | According to the invention, viscosity of the PDMS: 100 cSt |
| 2 | 10 | 5.80 | Comparison, no PDMS included in the spinning solution |

Example 3
Additive Content in the Final Fiber

| | |
|---|---|
| 0.3% by weight | magnesium stearate |
| 0.3% by weight | Silwet ® L 7607 (Union Carbide) |
| 1.0% by weight | Baysilonöl ® M 100 (Bayer AG), viscosity 100 cSt |

Example 4 (Comparison)
Additive Content in the Final Fiber

| | |
|---|---|
| 0.3% by weight | magnesium stearate |
| 0.3% by weight | Silwet ® L 7607 (Union Carbide) |

In Examples 3 and 4, the spinning solution was dry-spun in a spinning machine 10 meters in length to form filaments with an individual denier of 11 dtex, four individual filaments being combined to form coalesced filament yarns with a denier of 44 dtex which were wound at 500 m/minute.

As can be seen from Table 2, a distinct improvement in optical uniformity of 0.56 points is achieved by the process according to the invention, even in this modified spinning process.

TABLE 2

Improvement of optical uniformity in accordance with the invention - modified spinning process:

| Example | Number of tests | Test score (average) | Remarks |
|---|---|---|---|
| 3 | 64 | 5.50 | According to the invention, viscosity of the PDMS: 100 cSt |
| 4 | 25 | 6.06 | Comparison, no PDMS included in the spinning solution |

Example 5
Additive Content in the Final Fiber

| | |
|---|---|
| 0.3% by weight | magnesium stearate |
| 0.3% by weight | Silwet ® L 7607 |
| 1.0% by weight | Baysilonöl ® M 100, viscosity 300 cSt |

Example 6 (Comparison)
Additive Content in the Final Fiber

| | |
|---|---|
| 0.3% by weight | magnesium stearate |
| 0.3% by weight | Silwet ® L 7607 |
| 0.75% by weight | Baysilonöl ® M 100, viscosity 100 cSt |

Example 7
Additive Content in the Final Fiber

| | |
|---|---|
| 0.3% by weight | magnesium stearate |
| 0.3% by weight | Silwet ® L 7607 |
| 1.5% by weight | Baysilonöl ® M 100, viscosity 100 cSt |

Example 8 (Comparison)
Additive Content in the Final Fiber

| | |
|---|---|
| 0.3% by weight | magnesium stearate |
| 0.3% by weight | Silwet ® L 7607 |
| 1.0% by weight | Amylsiloxane-containing PDMS |

Example 9 (Comparison)
Additive Content in the Final Fiber

| | |
|---|---|
| 0.3% by weight | magnesium stearate without ethoxylated polydimethylsiloxane |
| 1.0% by weight | Baysilonöl ® M 100, viscosity 100 cSt |

In the series of tests for Examples 5 to 9, the spinning solution was again dry spun through spinnerets in a spinning machine 10 meters in length to form filaments with a denier of 11 dtex, 4 individual filaments being combined to form coalesced filament yarns with a denier of 44 dtex which were wound at 500 m/minute.

The results are set out in Table 3.

TABLE 3

Improvement of optical uniformity in accordance with the invention in relation to comparison inclusions in the spinning solution:

| Example | Number of tests | Test score (average) | Remarks |
|---|---|---|---|
| 5 | 1 | 4.83 | According to the invention, viscosity of the PDMS: 300 cSt |
| 6 | 3 | 5.25 | According to the invention, viscosity of the PDMS: 100 cSt, but concentration reduced to 0.75% |
| 7 | 1 | 4.50 | According to the invention, viscosity of the PDMS: 100 cSt, but concentration increased to 1.5% |
| 8 | 3 | 5.58 | Comparison, PDMS replaced by amyl-siloxane-containing PDMS |
| 9 | * | * | Comparison, with PDMS included in the spinning solution, viscosity 100 cSt, but without ethoxy-lated PDMS |

*In these tests, it was not possible to produce a sheet-form textile because the warping process was constantly hampered by entanglements which in turn resulted in filament breakages.

This series again reflects the distinct improvement in optical uniformity by 0.42 to 1.08 points where the spinning additives according to the invention are used.

What is claimed is:

1. In the production of elastane fibers from polyurea polyurethane by dry spinning or wet spinning, removing the spinning solvent, finishing, optionally twisting a solution thereof to form filaments winding the spun filaments, the improvement which comprises adding to the spinning solution before spinning, A) from 0.8 to 2% by weight of polydimethylsiloxane with a viscosity of 50 to 300 cSt and B) from 0.2 to 0.6% by weight of ethoxylated polydimethylsiloxane with a viscosity of 20 to 150 cSt (viscosities measured with a falling ball viscosimeter at 25° C.) the percentages being based on the siloxane content of the final fiber, whereby fabrics formed of the resulting yarn exhibit reduced defects when dyed.

2. A process according to claim 1, wherein the polyurea polyurethane solution is dry spun.

3. A process according to claim 1, wherein the weight ratio of A:B is 1:1 to 5:1.

4. A process according to claim 1, wherein the molecular weight (number average) of B is from 600 to 4,000.

5. A process according to claim 1, wherein B is of the formula

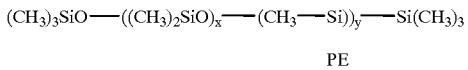

PE in which

PE is the single-bond unit $CH_2CH_2$—$CH_2O(EO)_mZ$,

Z is hydrogen or a $C_{1-6}$ alkyl radical,

EO is an ethylene oxide unit, and x, y, and z each independently is an integer of at least one, the values of x,y and z being interrelated so that B has a maximum molecular weight of 4,000.

6. A process according to claim 1, wherein A and B are first formed into a stock solution in the spinning solvent of from 15 to 20%, and the stock solution is then added to the spinning solution in the desired amount.

7. A process according to claim 1, wherein the resulting filaments are each of 10 to 160 denier.

8. A process according to claim 1, wherein spinning produces from 3 to 5 filaments of a total denier from 30 to 60.

9. A process according to claim 5, wherein A and B are first formed into a stock solution in the spinning solvent of from 15 to 20%, and the stock solution is then added to the spinning solution in the desired amount, the polyurea polyurethane solution is dry spun, the molecular weight (number average) of B is from 600 to 4,000, the weight ratio of A:B is 1:1 to 5:1, and the spinning process produces from 3 to 5 filaments of a total denier from 30 to 60.

* * * * *